US005451840A

United States Patent [19]

Abe et al.

[11] Patent Number: 5,451,840

[45] Date of Patent: Sep. 19, 1995

[54] CATHODE-RAY TUBE PROVIDING PROTECTION FROM ALTERNATING ELECTRIC FIELDS

[75] Inventors: Fumio Abe; Kouji Shingai; Hiroshi Okuda; Tetsuya Yamaguchi; Tomoki Takizawa, all of Nagaokakyo, Japan

[73] Assignee: Mitsubishi Denki Kabushiki Kaisha, Tokyo, Japan

[21] Appl. No.: 123,154

[22] Filed: Sep. 7, 1993

[30] Foreign Application Priority Data

Sep. 9, 1992 [JP] Japan ..... 4-240416

[51] Int. Cl.[6] ..... H01J 1/52

[52] U.S. Cl. ..... 315/85; 313/479; 315/8

[58] Field of Search ..... 315/8, 85; 313/478, 313/479

[56] References Cited

U.S. PATENT DOCUMENTS

| | | | |
|---|---|---|---|
| 4,786,973 | 11/1988 | Lock et al. . | |
| 4,853,601 | 8/1989 | Odenthal | 315/368 |
| 4,916,358 | 4/1990 | Bonton | 313/479 |
| 5,200,667 | 4/1993 | Iwasaki et al. | 313/478 |
| 5,243,262 | 9/1993 | Moen | 315/8 |
| 5,304,891 | 4/1994 | Otsuka | 313/479 |

FOREIGN PATENT DOCUMENTS

| | | |
|---|---|---|
| 500349 | 8/1992 | European Pat. Off. . |
| 1003359 | 2/1957 | Germany . |
| 3131180 | 6/1991 | Japan . |

OTHER PUBLICATIONS

*Electromagnetic Wave Trap for CRT Video Emanations,* J. A. Harder, Jr. and R. E. Neslund, IBM Technical Disclosure Bulletin, vol. 21, No. 5, Oct. 1978, pp. 1921–1922.

*Primary Examiner*—Robert J. Pascal
*Assistant Examiner*—Darius Gambino

[57] ABSTRACT

Human bodies are shielded from an alternating electric field radiated from a deflection yoke of a cathode-ray tube device to prevent the alternating electric field from adversely affecting the human bodies. For an alternating electric field traveling forward in the direction of a tube axis 28 of a cathode-ray tube, a cone section **1*b* is formed with a conductive film 17 for shielding an electric field and/or a face panel 2 is formed with a transparent conductive film 21 for shielding an electric field and the transparent conductive film 21 is grounded or an optimum potential is given only to the transparent conductive film 21** for shielding an electric field.

42 Claims, 11 Drawing Sheets

CATHODE-RAY TUBE PROVIDING PROTECTION FROM ALTERNATING ELECTRIC FIELDS

BACKGROUND OF THE INVENTION

1. Field of the Invention

This invention relates to a cathode-ray tube device and more particularly to shielding an alternating electric field radiated from a deflection yoke of the cathode-ray tube device.

2. Description of the Related Art

A conventional cathode-ray tube device is described with reference to FIGS. 8 to 10.

FIG. 9 is a drawing of the main unit of a conventional cathode-ray tube, wherein a funnel 1 consists of a neck section 1*a*, a cone section 1*b*, and a main funnel section 1*c* having a high voltage anode button 1*d*. The joint of the neck section 1*a* and the cone section 1*b* is called a neck seal line 1*e*. A face panel 2 is jointed to the front of the funnel 1 by using frit glass. A glass bulb 20 is thus formed.

An electron gun 3 is sealed inside the neck section 1*a*. An explosion-proof band 4 is wound around the perimeter of the face panel 2 to guarantee an explosion-proof characteristic, and ears 4*a* are provided at the four corners of the face panel 2 to connect the glass bulb 20 to a chassis (not shown) for grounding. Further, a silicon resin film 5 for insulation is formed around the high voltage anode button 1*d* disposed in the funnel main section 1*c*. A conductive film 6 for addition of capacitance is disposed on the perimeter of the main funnel section 1*c*. Normally, the conductive film 6 is formed by applying graphite. Numeral 28 is a straight line parallel to the neck section 1*a* and shows the tube axis of the cathode-ray tube.

The cathode-ray tube thus formed is provided with a deflection yoke to deflect an electron beam at a position between the cone section 1*b* and the neck section 1*a*, as shown in FIG. 8. The deflection yoke 7 consists of a horizontal deflecting coil 7*a*, a vertical deflecting coil 7*b*, and a deflection yoke main section 7*c*.

In operation, when an electron beam is emitted from the electron gun 8 sealed in the neck section 1*a*, the electron beam is deflected a predetermined amount in the horizontal and vertical directions by the horizontal deflecting coil 7*a* and the vertical deflecting coil 7*b* of the deflection yoke 7 and scans on a fluorescent film formed on the inner face of the face panel 2 for displaying a desired image.

FIG. 11 shows another conventional example. A transparent conductive film 21 is disposed on the outer surface of a face panel 2 of the cathode-ray tube. The conductive film 21 is connected to an explosion-proof band 4 and further to a conductive film 6 for addition of capacitance by a conduction tape 18. Since the conductive film 6 for addition of capacitance is grounded through ground wire 29, the potential of the conductive film 21 is also zero volts.

The conductive film 21 is provided to prevent charging on the surface of the face panel 2, to suppress glare of reflection, etc., and to reduce electronic waves radiated forward from the deflection yoke 7 (Japanese Patent Lain-Open Nos.Sho 61-101950 and Hei 3-131180).

The deflection yoke generates an alternating field so as to cause an electron beam to scan on the inner surface of the face panel of the cathode-ray tube; at the same time, it also radiates an alternating electric field.

In recent years, the harmful effects of an electro-magnetic wave to human bodies have been considered an issue and with respect to display monitors, tile harmful effects of an alternating field emitted mainly from a deflecting yoke to the human bodies have also been feared. From such viewpoints, in 1991, MPR (National Council for Netrelogy and Testing), TCO (Central Organization of Salaried Employees in Sweden), etc., proposed standards for allowable electro-magnetic waves radiated from display monitors, as listed in Table 1.

TABLE 1

| | ELF band 5 Hz–2 kHz | VLF band 2 kHz–400 kHz | Test Conditions |
|---|---|---|---|
| MPR | 25 V/m or less | 2.5 V/m or less | Temperature 20° C. humidity 21% at a point of 50 cm distant from CRT face |
| TCO | 10 V/m or less | 1.0 V/m or less | Temperature 20° C. humidity 21% at a point of 30 cm distant from CRT face |

A treatment for sufficiently shielding an alternating electric field radiated from a deflection yoke is not applied to conventional cathode-ray tube devices. Table 2 lists alternating electric fields [VLF band] on the front of the CRT. Measurement by the inventor reveals that the alternating electric fields (VLF band) depend on horizontal scanning frequencies; as the horizontal scanning frequency rises, the alternating electric fields (VLF band) also increase. Alternating electric fields leaked through the funnel and face panel of the CRT can adversely affect the observer.

TABLE 2

| Charge-resistant 16-inch CRT with coating treatment of $2.6 \times 10^9\ \Omega$ given to face plate | | | |
|---|---|---|---|
| CRT type | | Charge-resistant CRT | |
| Test method | | MPR | TCO |
| Alternating electric field VLF band (V/m) | Horizontal frequency 31 kHz | 2.3 V/m | 5.0 V/m |
| | Horizontal frequency 45 kHz | 3.4 V/m | 8.3 V/m |
| | Horizontal frequency 64 kHz | 4.8 V/m | 12.0 V/m |

SUMMARY OF THE INVENTION

Accordingly, it is an object of the invention to provide a cathode-ray tube where an alternating electric field at 2 to 400 kHz (hereinafter, called a VLF band), which is particularly hard to reduce, is reduced.

As first solving means of the invention, a conductive film for shielding an electric field is formed in a predetermined area from a cone section to a neck section of a funnel where a deflection yoke is mounted, and the clearance between the deflection yoke and the conductive film is filled with a natural cured resin to electrically insulate the conductive film from the coils of the deflection yoke.

As second solving means of the invention, a desired potential is applied to a transparent conductive film for shielding an electric field formed on the outer surface of a face panel.

As third solving means of the invention, a conductive film for shielding an electric field is formed in a predetermined area from a cone section to a neck section of a funnel where a deflection yoke is mounted and further a transparent conductive film for shielding an electric field is formed on the outer surface of a face panel.

The first solving means of the invention shields an alternating electric field, radiated from the deflection yoke and traveling forward substantially in parallel to the tube axis direction, by the electric field shielding conductive film formed on the funnel before emission of the alternating electric field.

The second solving means of the invention provides good shielding of an alternating electric field, radiated from a deflection yoke and reaching a face panel, by a conductive film for shielding an electric field at a potential selected so as to optimally shield the alternating electric field.

The third solving means of the invention provides a sufficient shielding of an alternating electric field, radiated from a deflection yoke and attemping to travel forward, by a double electric field shielding effect.

DESCRIPTION OF THE PREFERRED EMBODIMENTS

Referring now to the accompanying drawings, there are shown embodiments of the invention.

Figure 1:
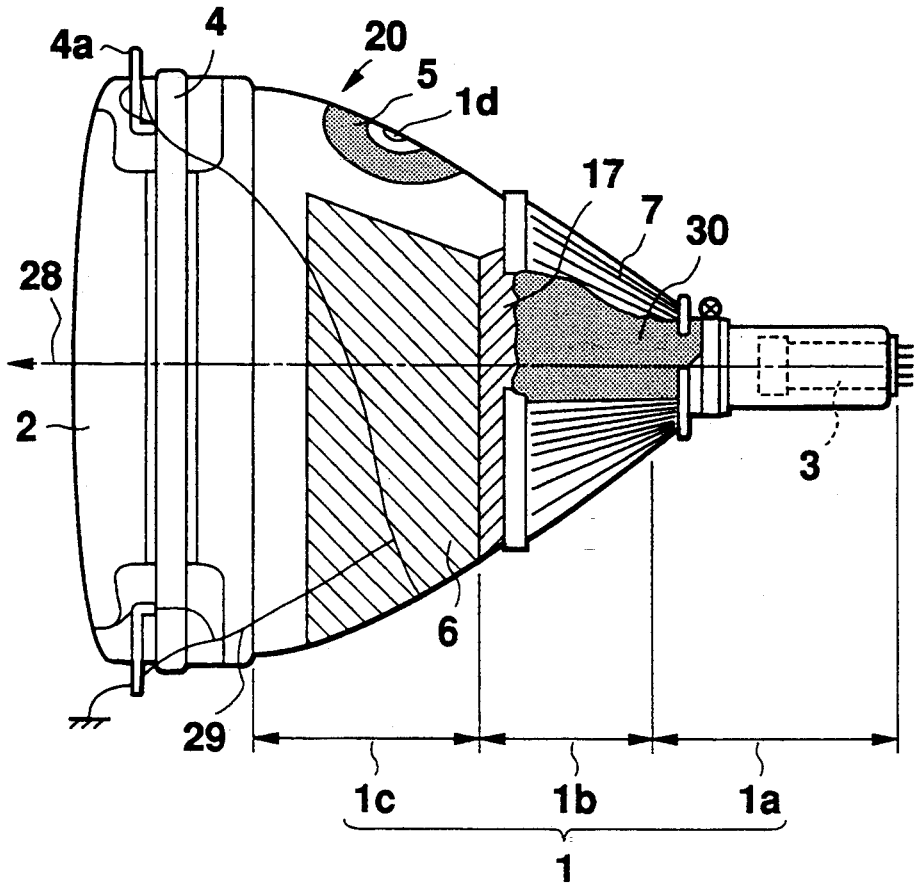
FIG. 1 is a structural drawing of a cathode-ray tube device according to first solving means of the invention.
Figure 8:
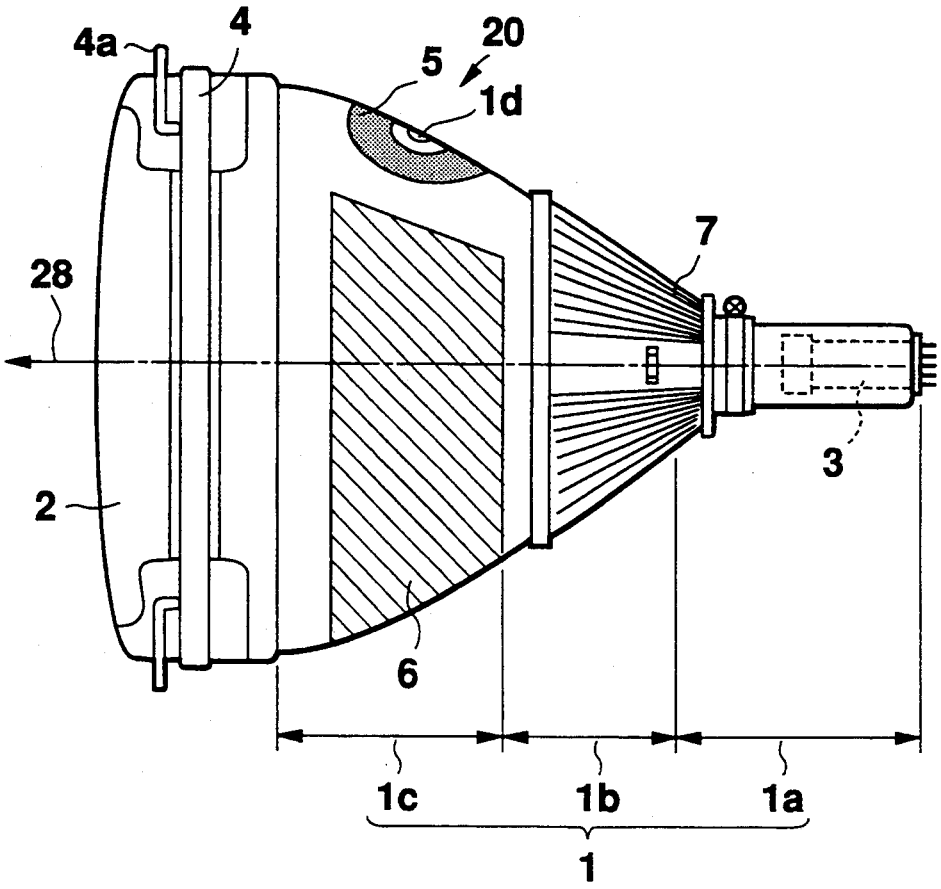
Fig. 8 PRIOR ART
FIG. 8 is a structural drawing of a conventional cathode-ray tube device.
Figure 9:
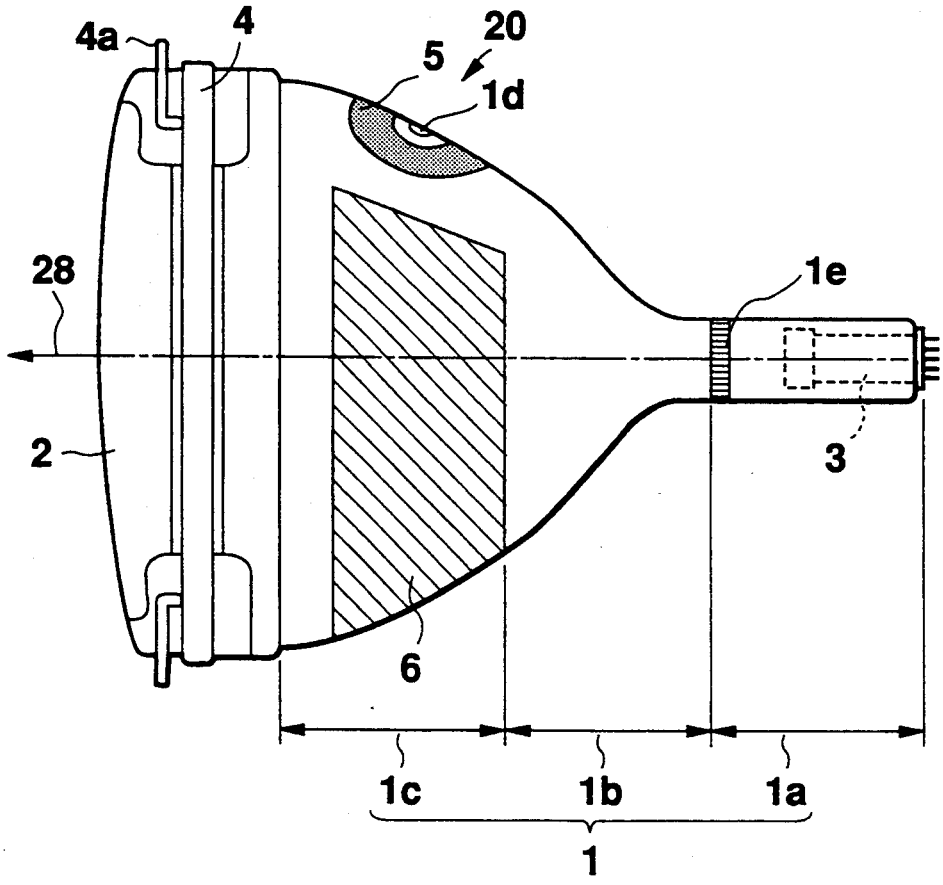
Fig. 9 PRIOR ART
FIG. 9 is a drawing showing the main unit of the cathode-ray tube device in FIG. 8.

FIG. 1 shows an embodiment of a first solving means of the invention, wherein numeral 1 is a funnel, numeral 1*a* is a neck section, numeral 1*b* is a cone section, numeral 1*c* is a main funnel main section, numeral 1*d* is a high voltage anode button, numeral 2 is a face panel, numeral 3 is an electron gun, numeral 4 is an explosion-proof band, and numeral 4*a* is an ear, numeral 5 is a silicon resin film, numeral 6 is a conductive film for addition of capacitance, numeral 7 is a deflection yoke, and numeral 28 is a tube axis. These are identical with those of the conventional cathode-ray tube device shown in FIG. 8. Numeral 17 is a conductive film for shielding an electric field. The conductive film 17 is provided by applying graphite from the cone section 1*b* to the outer face of the neck section 1*a* and is formed in a predetermined region covering an opening of the deflection yoke 7. The conductive film 17 is connected to the conductive film 6 for addition of capacitance and is grounded through the explosion-proof band 4 by a ground wire 29, forming an electric field shielding face. The clearance between the conductive film 17 and the deflection yoke 7 is filled with a natural cured resin 30 for electric insulation.

In operation, by grounding the explosion-proof band 4 in the cathode-ray tube thus formed, the conductive film 17 becomes an equipotential surface of 0 V and has an electric field shielding effect on an alternating electric field traveling forward from the deflection yoke 7. Thus, the alternating electric field emitted from the deflection yoke 7 is attenuated by the conductive film 17. Since the clearance between the horizontal deflecting coil 7*a* of the deflection yoke 7 and the conductive film 17 is filled with the natural cured resin, the horizontal deflecting coil 7*a* and the conductive film 17 are electrically insulated from each other, and a problem of discharging, etc., and degradation with age of insulation performance do not occur. The natural cured resin may be epoxy resin, silicon resin, etc., if the resin is an insulator.

Figure 2:
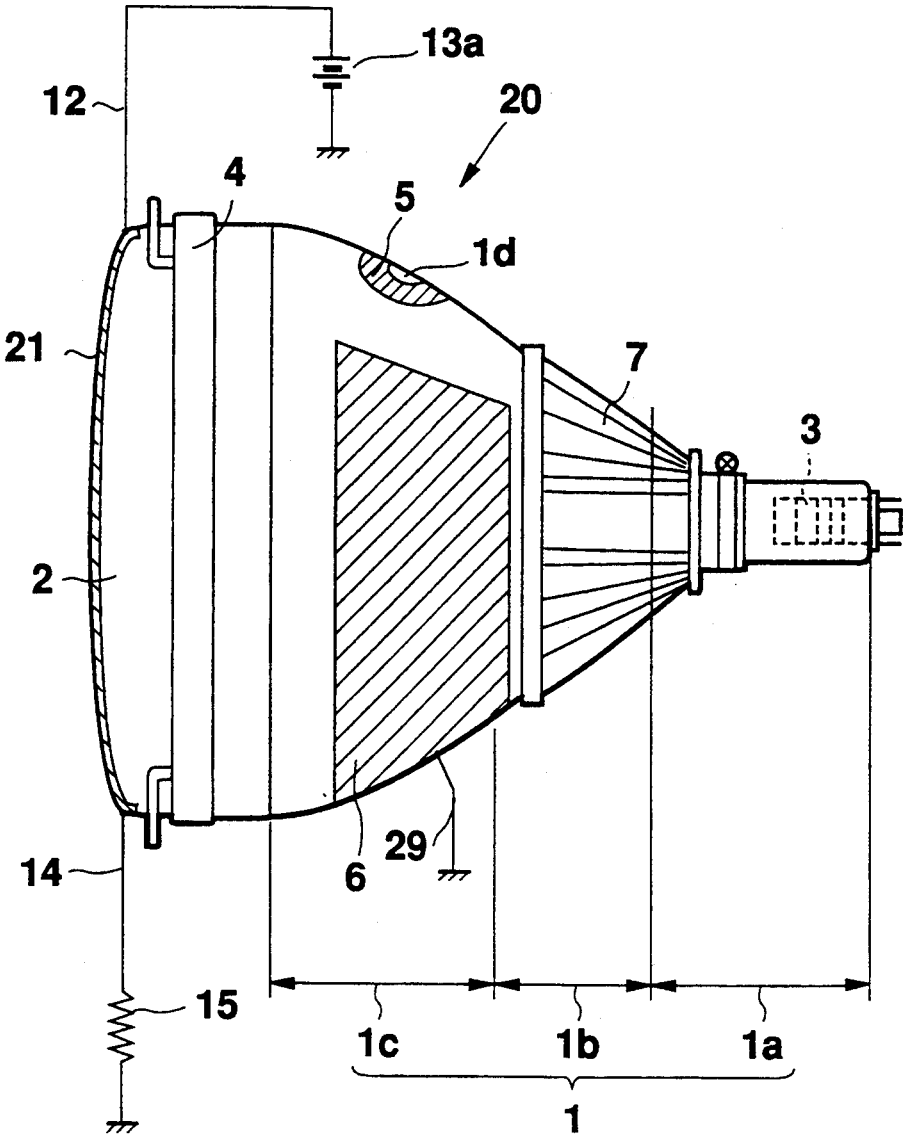
FIG. 2 is a structural drawing of a cathode-ray tube device according to second solving means of the invention.
Figure 11:
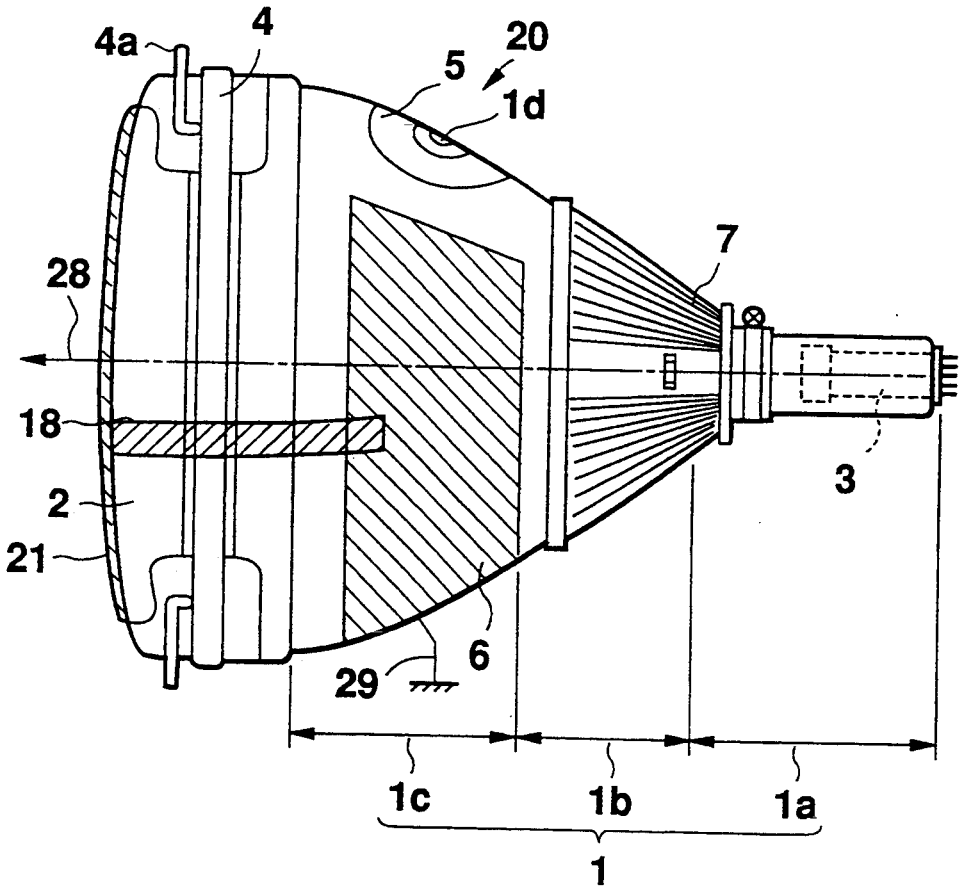
Fig. 11 (PRIOR ART)
FIG. 11 is a structural drawing of a conventional cathode-ray tube device of another form.

FIG. 2 shows an embodiment of a second solving means of the invention, wherein numeral 1 is a funnel, numeral 1*a* is a neck section, numeral 1*b* is a cone section, numeral 1*c* is a main funnel section, numeral 1*d* is a high voltage anode button, numeral 2 is a face panel, numeral 3 is an electron gun, numeral 4 is an explosion-proof band, and numeral 4*a* is an ear, numeral 5 is a silicon resin film, numeral 6 is a conductive film for addition of capacitance, numeral 7 is a deflection yoke, numeral 21 is a transparent conductive film, and numeral 29 is a ground wire. These components are identical with those of the conventional cathode-ray tube device shown in FIG. 11 except that the transparent conductive film 21 is not connected to the explosion-proof band 4 for grounding; one end of the transparent conductive film 21 is connected to a DC power supply 13*a* by a conductor 12 and the opposite end is grounded by a conductor 14 via a resistor 15 having a predetermined resistance value.

In operation, since a voltage can be applied from the DC power supply 13*a* to the transparent conductive film 21 disposed on the outer face of the face panel 2 in the cathode-ray tube device thus formed, a desired equipotential surface can be formed on the transparent conductive film 21. Any desired potential can be set by the power supply 13*a* and the resistor 15. Formerly, since the transparent conductive film 21 was grounded, only a uniform potential of 0 volts was able to be set. In contrast, the invention enables a proper voltage to be applied to the transparent conductive film 21 to form a proper electric field shielding face in response to the strength of an alternating electric field emitted by the deflection yoke 7, the alternating frequency, and the operation state of the cathode-ray tube. The transparent conductive film 21 may be any film as long as it is transparent and conductive; it may also be provided by applying paint with fine particles of indium as a filler to the full face of the face panel 2.

Figure 3:
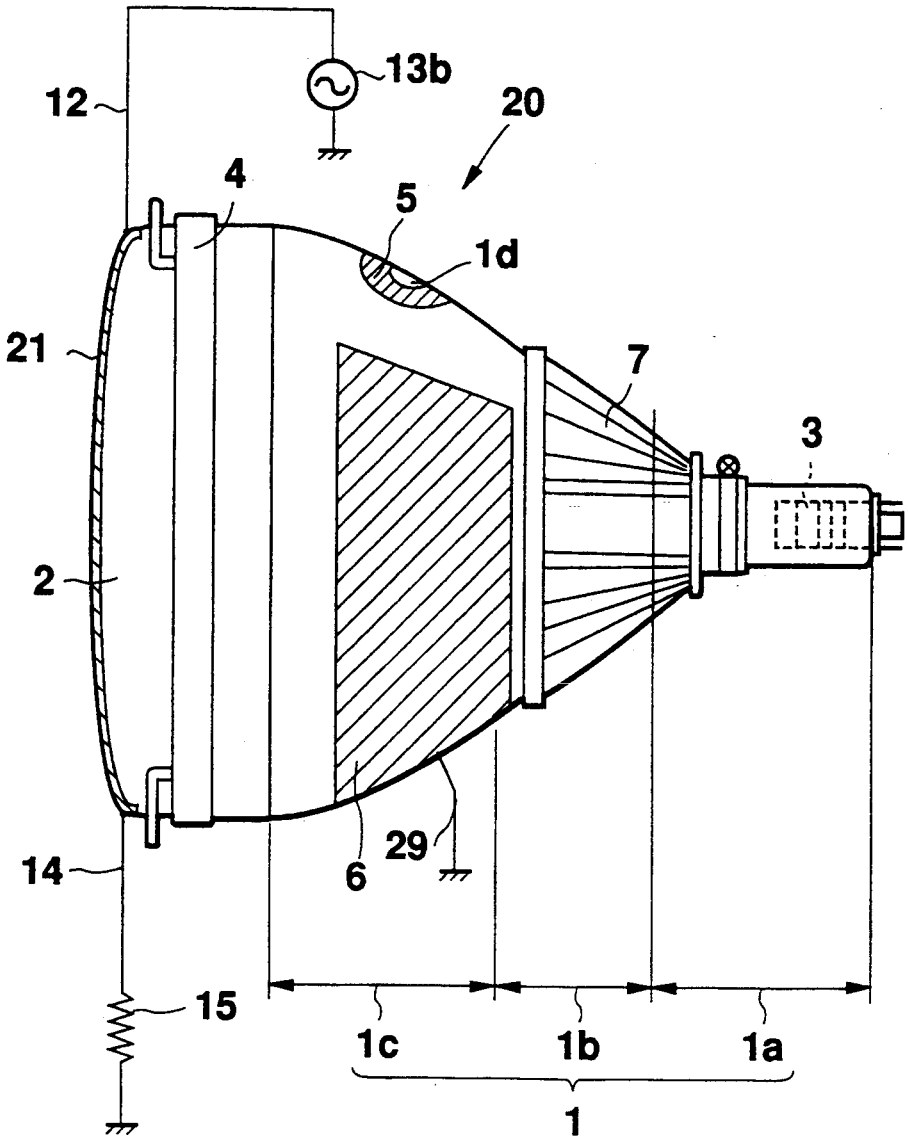
FIG. 3 is a structural drawing of a cathode-ray tube device of another form according to the second solving means of the invention.
Figure 4A:
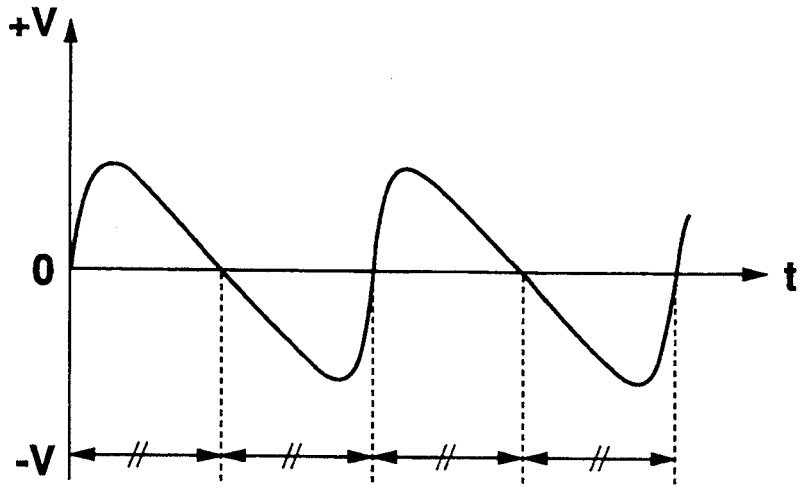
FIG. 4A is a graph illustrating the phase of an alternating voltaic emitted by a deflection yoke.
Figure 4B:
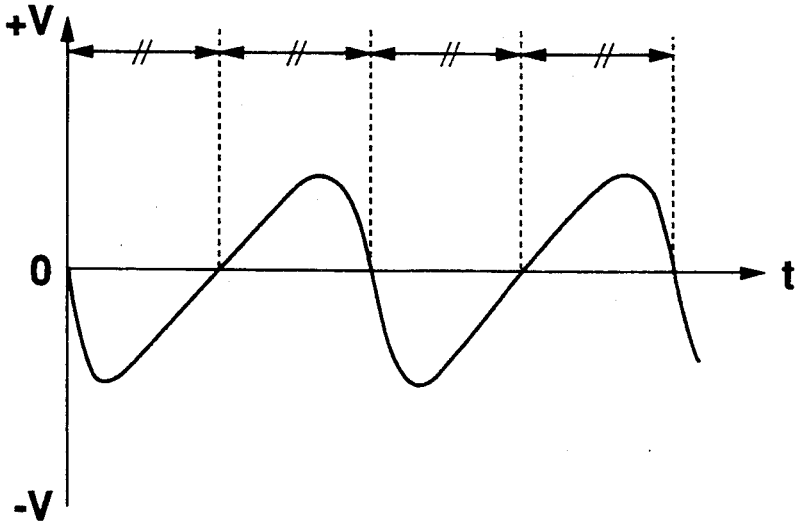
FIG. 4B is a graph illustrating alternating voltage of opposite phase applied to a transparent conductive film for shielding an electric field of the cathode-ray tube device in FIG. 3.

FIG. 3 shows another embodiment of the second solving means. In the embodiment, in place of the DC power supply 13*a* in FIG. 2, an AC power supply 13*b* is used to give an alternating potential to a transparent conductive film 21. The alternating potential is as shown in FIG. 4 (*b*). It is opposite in phase to the alternating electric field emitted by a deflection yoke 7 shown in FIG. 4 (*a*). Therefore, the transparent conductive film 21 to which such an alternating field is given can shield the alternating electric field radiated from the deflection yoke 7 efficiently.

Figure 5:
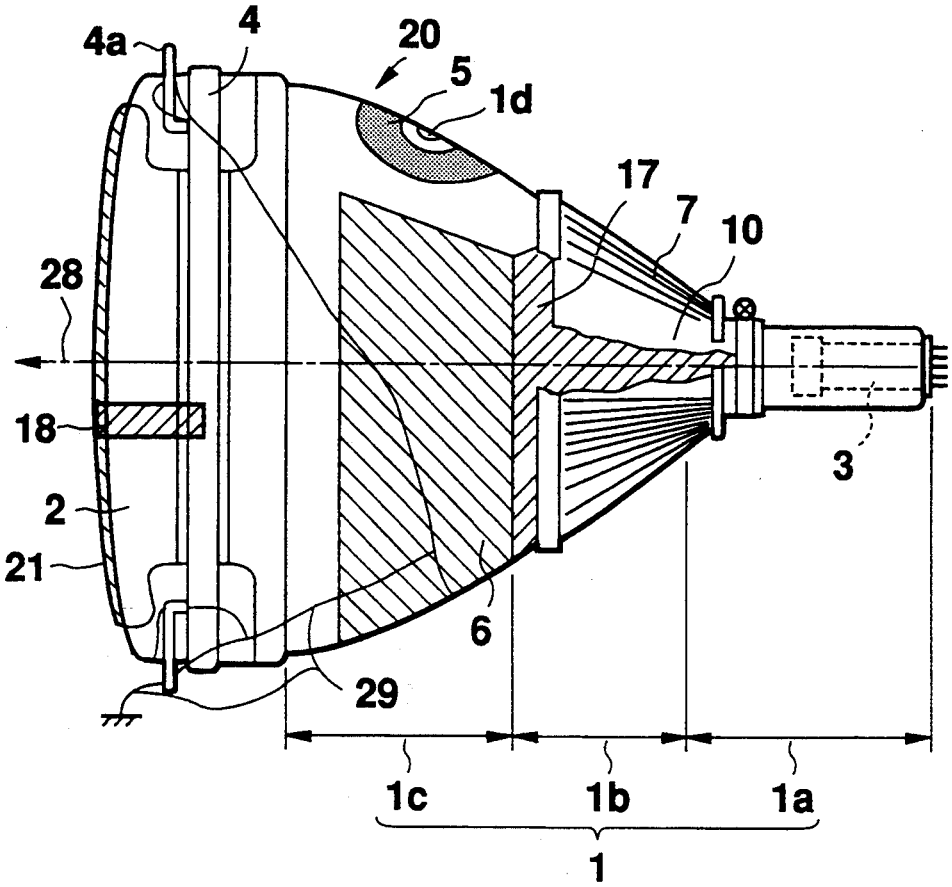
FIG. 5 is a structural drawing of a cathode-ray tube device according to third solving means of the invention.

FIG. 5 shows an embodiment of a third solving means of the invention, wherein numeral 1 is a funnel, numeral 1*a* is a neck section, numeral 1*b* is a cone section, numeral 1*c* is a main funnel section, numeral 1*d* is a high voltage anode button, numeral 2 is a face panel, numeral 3 is an electron gun, numeral 4 is an explosion-proof band, and numeral 4*a* is an ear, numeral 5 is a silicon resin film, numeral 6 is a conductive film for addition of capacitance, numeral 7 is a deflection yoke, numeral 18 is a conduction tape, and numeral 29 is a ground wire. These are identical with those of the conventional cathode-ray tube device shown in FIG. 11. Numeral 17 is a conductive film for the first electric field shield provided by applying graphite to a predetermined region from tile cone section 1*b* to the neck section 1*a* so as to electrically connect to the conductive film 6 to form the first electric field shielding face; it is formed so as to cover the full opening of the deflection yoke. Numeral 10 is a funnel-shaped insulating sheet with which the conductive film 17 is covered to electrically insulate the conductive film 17 and the coil section of the deflection yoke 7 from each other. The deflection yoke 7 is attached through the funnel-shaped insulating sheet 10 to the funnel 1. Numeral 21 is a transparent conductive film for the second electric field shield provided by applying paint with fine particles of indium oxide as a filler to the full face of the face panel. The transparent conductive film 21 is connected to the explosion-proof band 4 by the conduction tape 18 and is grounded by the ground wire 29. The conductive film 17 is also grounded by the ground wire 29 through the conductive film 6 for addition of capacitance.

In operation, by grounding the explosion-proof band 4 in the cathode-ray tube device thus formed, the transparent conductive film 21 and the conductive film 17 become equipotential surfaces of 0 V, and a face having an electric field shielding effect is formed in the front area of the deflection yoke 7 and on the surface of the face panel 2. The alternating electric field emitted from the deflection yoke 7 is attenuated by the first electric field shielding face formed on the funnel 1 and further by tile second electric field shielding face formed on the face panel 2. Since the insulating sheet 10 intervenes between the horizontal deflecting coil 7*a* of the deflection yoke and the conductive film 17, the horizontal deflecting coil 7*a* and the conductive film 17 are electrically insulated from each other, and a problem of discharging, etc., does not occur.

Thus, according to the embodiment, the alternating electric field emitted from the deflection yoke 7 through the funnel 1 to the face panel 2 and radiated therefrom was able to be reduced to 1/10 or less compared with the CRT with no treatment (as listed in Table 2), as listed in Table 3, according to measurement obtained by the inventor, due to a multiplying effect of multiple stages of electric field shielding formed on the funnel and on the face panel 2. The second solving means of the invention was also able to produce results similar to that listed in Table 3.

TABLE 3

(16-inch CRT)
Product with $6 \times 10^9\ \Omega$
coating on face panel + conductive film on funnel.

| CRT type | | CRT of the Invention | |
|---|---|---|---|
| Test method | | MPR | TCO |
| Alternating electric field VLF band (V/m) | Horizontal frequency 31 kHz | 0.1 V/m | 0.3 V/m |
| | Horizontal frequency 45 kHz | 0.2 V/m | 0.5 V/m |
| | Horizontal frequency 64 kHz | 0.3 V/m | 0.8 V/m |

Figure 6:
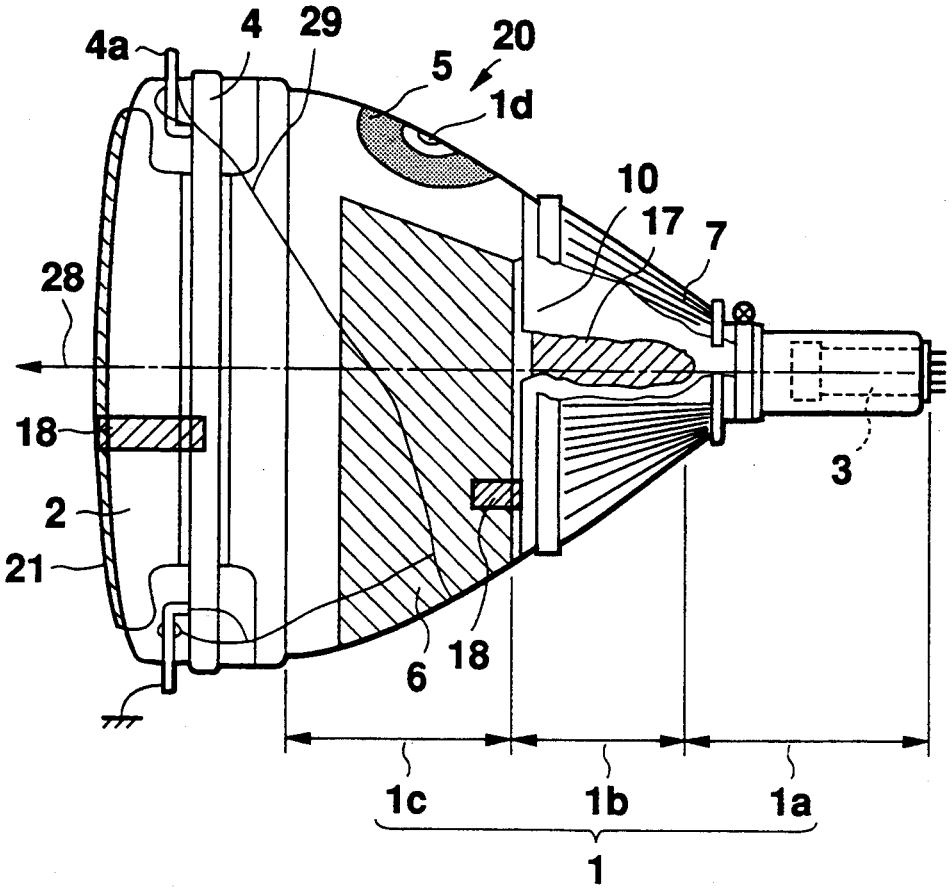
FIG. 6 is a structural drawing of a cathode-ray tube device of another form according to the third solving means of the invention.
Figure 7:
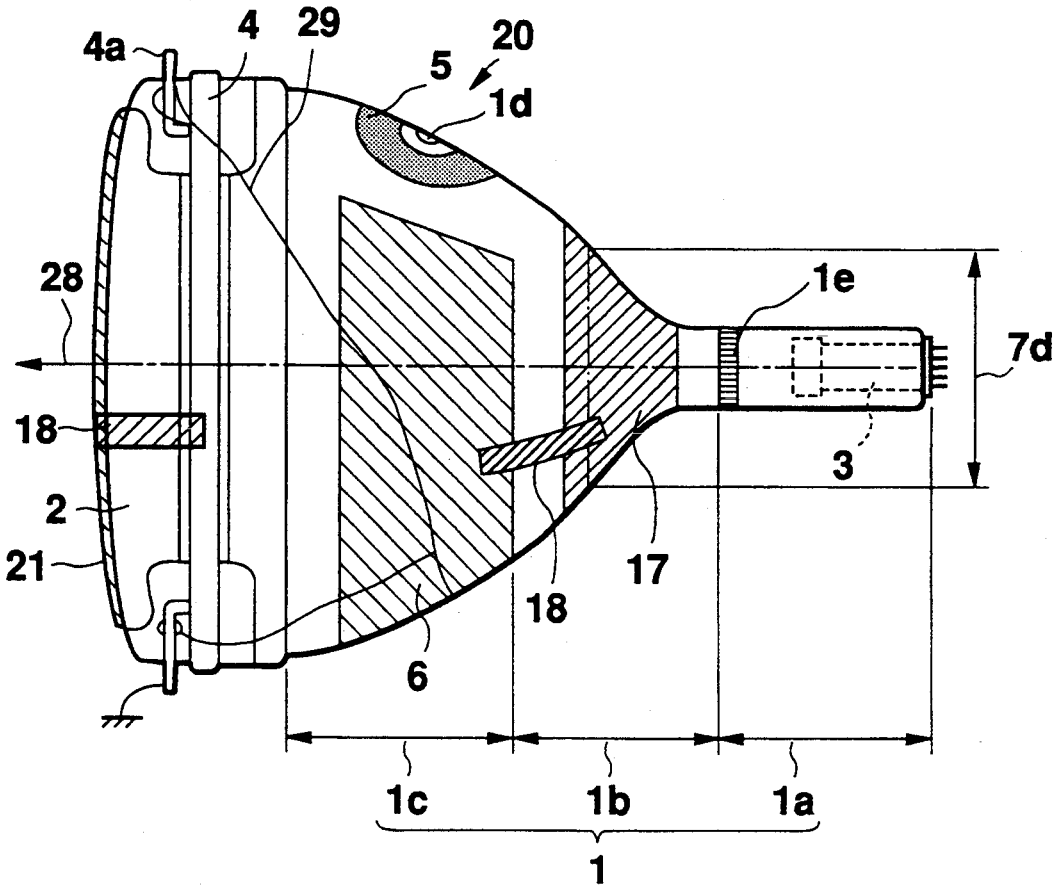
FIG. 7 is a drawing showing the main unit of the cathode-ray tube device in FIG. 6.
Figure 10:
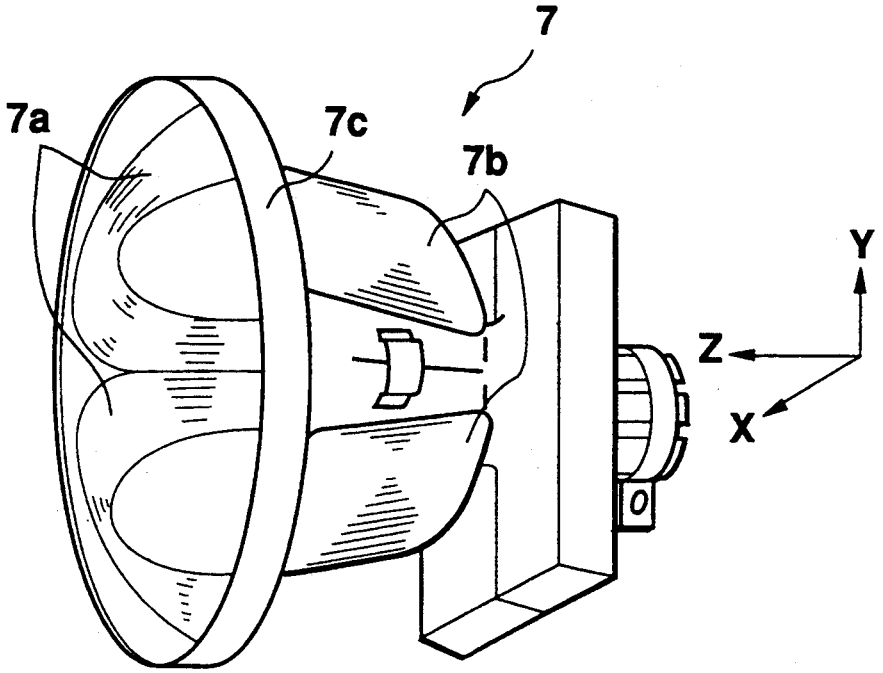
Fig. 10 PRIOR ART
FIG. 10 is an enlarged perspective view showing a deflection yoke installed in the cathode-ray tube device in FIG. 8.

FIGS. 6 and 7 show another embodiment of the third solving means of the invention. In the embodiment, a conductive film 17 is formed only in a predetermined area of a cone section 1*b* rather than a neck seal line 1*e* which is the joint of a neck section 1*a* and the cone section 1*b* of a funnel 1. In FIG. 7, numeral 17 is a conductive film provided to form an electric field shielding face by applying graphite. The conductive film 17 is formed in an area surrounded by the circumference of a circle on the funnel outer surface having a larger diameter than the maximum diameter 7*d* of a horizontal deflecting coil 7*a* of a deflection yoke 7 and tile circumference of a circle on the funnel outer surface at least 5 mm away from the neck seal line 1*e* towards a face panel, 2 in the direction of a tube axis 28 from the neck seal line 1*e*. The conductive film 17 is electrically connected to a conductive film 6 by a conduction tape 18. A funnel-shaped insulating sheet 10 is designed to have a form and size which enables it to completely cover the conductive film 17, and intervenes between the deflection yoke 7 and the conductive film 17, as shown in FIG. 6. That is, the deflection yoke 7 is mounted on the insulating sheet 10. The maximum diameter 7*d* of the horizontal deflecting coil 7*a* of the deflection yoke 7 in FIG. 7 refers to the maximum diameter of the coil on the section when the horizontal deflecting coil 7*a* shown in FIG. 10 is cut on the X-Y plane. Therefore, if the X-Y section of the coil is elliptical, the maximum diameter of the coil refers to the major axis of the ellipse.

In operation, by grounding an explosion-proof band 4 in the cathode-ray tube device thus formed, a transparent conductive film 21 and the conductive film 17 become equipotential surfaces of 0 V, and a face having an electric field shielding effect is formed in the front area of the deflection yoke 7 and on the surface of the face panel 2. The alternating electric field emitted from the deflection yoke 7 is attenuated by the first electric field shielding face formed on the funnel 1 and further by the second electric field shielding face formed on the face panel 2. Since the insulating sheet 10 intervenes between the horizontal deflecting coil 7*a* of the deflection yoke 7 and the conductive film 17, the horizontal deflecting coil 7*a* and the conductive film 17 are electrically insulated from each other, and a problem of discharging, etc., does not occur.

Thus, according to the embodiment, the alternating electric field emitted from the deflection yoke 7 through the funnel 1 to the face panel 2 and radiated therefrom was able to be reduced to 1/10 compared with the CRT with no treatment, due to a multiplying effect of multiple stages of electric field shielding formed on the funnel 1 and on the face panel 2.

The end of the conductive film 17, namely, the face panel side of the conductive film 17 becomes the circumference of a circle having a larger diameter than the maximum diameter 7*d* of the horizontal deflecting coil 7*a* of the deflection yoke 7, thus an electric field shielding face which can sufficiently shield the alternating electric field radiated from the deflection yoke 7 can be formed. The conductive film 17 is formed in a region at least 5 mm away from the neck seal line 1*e* towards the face panel 2 in the direction of the tube axis 28 from the neck seal line 1*e*, thus the neck seal line 1*e* can be held in the high electric resistance state.

The first solving means of the invention has the effect of shielding the alternating electric field emitted from the deflection yoke by the electric field shielding conductive film disposed on the funnel before emission of the alternating electric field and sufficiently maintaining insulation performance for a long time by filling with natural cured resin.

The second solving means of the invention has the effect of accomplishing a good shielding effect because the transparent conductive film for shielding an electric field on the surface of the face panel is given a proper potential.

The third solving means of the invention has the effect of sufficiently shielding the alternating electric field emitted from the deflection yoke by a multiplying effect of multiple stages of electric field shielding formed on the funnel and on the face panel.

What is claimed is:

1. A cathode-ray tube device comprising:
(a) a funnel including:
(i) a neck section in which an electron gun is sealed;
(ii) a main funnel section; and
(iii) a cone section for connecting said neck section and said main funnel section;
(b) a face panel having a fluorescent film on an inner face thereof and being connected to another end of said main funnel section opposite to one end of said main funnel section to which said cone section is connected;
(c) a deflection yoke being fitted onto said cone section of said funnel and containing coils for deflecting an electron beam emitted from said electron gun;
(d) a first conductive film for shielding an electric field disposed on a periphery of said funnel, in a predetermined area of said cone section where said deflection yoke is fitted;
(e) ground means for grounding said first conductive film; and
(f) an insulator disposed between said first conductive film and said deflection yoke for electrically insulating said first conductive film from said coils in said deflection yoke.

2. The cathode-ray tube device as claimed in claim 1, wherein said main funnel section is formed with a second conductive film being grounded by a ground wire for addition of capacitance in a part of a periphery thereof, and said ground means electrically connecting said conductive film and said second conductive film.

3. The cathode-ray tube device as claimed in claim 2, further including an explosion-proof band wound around a perimeter of said face panel to guarantee an explosion-proof characteristic, wherein said ground wire is grounded through said explosion-proof band from said second conductive film.

4. A cathode-ray tube device comprising:
(a) a funnel including:
(i) a neck section in which an electron gun is sealed;
(ii) a main funnel section; and
(iii) a cone section for connecting said neck section and said main funnel section;
(b) a face panel having a fluorescent film on an inner face thereof and being connected to another end of said main funnel section opposite to one end of said main funnel section to which said cone section is connected;
(c) a deflection yoke being fitted onto said cone section of said funnel and containing coils for deflecting an electron beam emitted from said electron gun;
(d) a transparent conductive film formed on an outer surface of said face panel;
(e) a power supply connected to one end of said transparent conductive film for applying an optimum potential to said transparent conductive film for shielding an alternating electric field emitted from said deflection yoke; and
(f) a resistor having a predetermined value connecting an opposite end of said transparent conductive film and a ground.

5. The cathode-ray tube device as claimed in claim 4, wherein said power supply is a direct current power supply.

6. The cathode-ray tube device as claimed in claim 4, wherein said power supply is an alternating current power supply connected to one whose phase is opposite to that of the alternating electric field emitted from said deflection yoke.

7. A cathode-ray tube device comprising:
(a) a funnel including:
(i) a neck section in which an electron gun is sealed;
(ii) a main funnel section; and
(iii) a cone section for connecting said neck section and said main funnel section;
(b) a face panel having a fluorescent film on an inner face thereof and being connected to another end of said main funnel section opposite to one end of said main funnel section to which said cone section is connected;
(c) a deflection yoke being fitted onto said cone section of said funnel and containing coils for deflecting an electron beam emitted from said electron gun;
(d) a first conductive film disposed between an outer periphery of said cone section of said funnel and said deflection yoke, for shielding an electric field formed by said deflection yoke;
(e) a transparent conductive film formed on an outer surface of said face panel; and
(f) ground means for grounding said first conductive film and said transparent conductive film.

8. The cathode-ray tube device as claimed in claim 7, wherein said main funnel section is formed with a second conductive film being grounded by a ground wire for addition of capacitance in a part of a periphery thereof, and said ground means electrically connecting said first conductive film and said second conductive film and also indirectly connecting said transparent conductive film to said second conductive film.

9. The cathode-ray tube device as claimed in claim 8, further including an explosion-proof band wound around a perimeter of said face panel to guarantee an explosion-proof characteristic, wherein said transparent conductive film is connected to said explosion-proof band by a conduction tape and said ground wire is grounded through said explosion-proof band from said second film.

10. The cathode-ray tube device as claimed in claim 7, further including an insulating sheet located in a clearance between said first conductive film and said deflection yoke for electrically insulating said electric field shielding conductive film from said coils in said deflection yoke.

11. The cathode-ray tube device as claimed in claim 10, wherein said insulating sheet covers said first conductive film and has a funnel-like form.

12. A cathode-ray tube device comprising:

(a) a funnel including:

(i) a neck section in which an electron gun is sealed;

(ii) a main funnel section; and (iii) a cone section for connecting said neck section and said main funnel section;

(b) a face panel having a fluorescent film on an inner face thereof and being connected to another end of said main funnel section opposite to one end of said main funnel section to which said cone section is connected;

(c) a deflection yoke being fitted onto said cone section of said funnel, including:

a horizontal deflecting coil for deflecting an electron beam emitted from said electron gun a predetermined amount in the horizontal direction;

(d) a first conductive film disposed on a periphery of said funnel for shielding an electric field, in an area surrounded by a first circumference of a circle on an outer surface of said funnel having a larger diameter than the maximum diameter of said horizontal deflecting coil in said deflection yoke, and a second circumference of a circle on the funnel outer surface at least a predetermined distance away from a joint of said neck section towards said face panel;

(e) a transparent conductive film formed on an outer surface of said face panel; and (f) means for grounding said first conductive film and said transparent conductive film.

13. The cathode-ray tube device as claimed in claim 12, wherein said main funnel section is formed with a second conductive film being grounded by a ground wire for addition of capacitance in a part of a periphery thereof, and said first conductive film and said second conductive film are electrically connected by a conduction tape.

14. The cathode-ray tube device as claimed in claim 12, wherein said main funnel section is formed with a second conductive film being grounded by a ground wire for addition of capacitance in a part of a periphery thereof, and said ground means electrically connecting said first conductive film and said second conductive film and also indirectly connecting said transparent conductive film to said second conductive film.

15. The cathode-ray tube device as claimed in claim 14, further including an explosion-proof band wound around a perimeter of said face panel to guarantee an explosion-proof characteristic, wherein said transparent conductive film is connected to said explosion-proof band by a conduction tape and said ground wire is grounded through said explosion-proof band from said second conductive film.

16. The cathode-ray tube device as claimed in claim 12, further including an insulating sheet located in a clearance between said conductive film and said deflection yoke for electrically insulating said first conductive film from said horizontal deflecting coil in said deflection yoke.

17. The cathode-ray tube device as claimed in claim 12, wherein said insulating sheet covers said first conductive film and has a funnel-like form.

18. A cathode-ray tube device as claimed in claim 1, wherein said insulator contains a natural cured resin.

19. A cathode-ray tube device as claimed in claim 12, wherein said predetermined distance is approximately 5 mm.

20. A method for providing protection from alternating electric fields in cathode ray tube including a neck section in which an electron gun is sealed, a main funnel section, a cone section for connecting the neck section and the main funnel section, a face panel having a fluorescent film on an inner face thereof and being connected to another end of the main funnel section to which the cone section is connected, and a deflection yoke being fitted onto the cone section and containing coils for deflecting an electron beam emitted from the electron gun, comprising the steps of:

shielding a periphery of said cone section with a first conductive film where said deflection yoke is being fitted;

grounding said first conductive film; and electrically insulating said first conductive film and said coils in said deflecting yoke.

21. The method for providing protection from alternating electric fields in cathode ray tube of claim 20, wherein said grounding step comprising the substep of:

electrically connecting said first conductive film and a second conductive film provided on a periphery of said main funnel section for addition of capacitance.

22. The method for providing protection from alternating electric fields in cathode ray tube of claim 21, wherein said electrically connecting step comprising the substep of:

grounding said second conductive film through an explosion-proof band wound around a perimeter of said face panel.

23. A method for providing protection from alternating electric fields in cathode ray tube including a neck section in which an electron gun is sealed, a main funnel section, a cone section for connecting the neck section and the main funnel section, a face panel having a fluorescent film on an inner face thereof and being connected to another end of the main funnel section to which the cone section is connected, and a deflection yoke being fitted onto the cone section and containing coils for deflecting an electron beam emitted from the electron gun, comprising the steps of:

forming a transparent conductive film on an outer surface of said face panel;

supplying power to one end of said transparent conductive film for applying an optimum potential to said transparent conductive film for shielding an alternating electric field emitted from said deflection yoke; and connecting a resistor having a predetermined value between an opposite end of said transparent conductive film and a ground.

24. The method for providing protection from alternating electric fields in cathode ray tube of claim 23, wherein said step for supplying power comprising the substep of:

applying a direct current to said one end of the transparent conductive film.

25. The method for providing protection from alternating electric fields in cathode ray tube of claim 23, wherein said step for supplying power comprising the substep of:

applying an alternating current whose phase is opposite to that of the alternating electric field emitted from said deflection yoke.

26. A method for providing protection from alternating electric fields in cathode ray tube including a neck section in which an electron gun is sealed, a main funnel section, a cone section for connecting the neck section and the main funnel section, a face panel having a fluorescent film on an inner face thereof and being connected to another end of the main funnel section to which the cone section is connected, and a deflection yoke being fitted onto the cone section and containing coils for deflecting an electron beam emitted from the electron gun, comprising the steps of:

shielding a periphery of said cone section with a first conductive film where said deflection yoke is being fitted;

forming a transparent conductive film on an outer surface of said face panel; and grounding said first conductive film and said transparent conductive film.

27. The method for providing protection from alternating electric fields in cathode ray tube of claim 26, wherein said grounding step comprising the substep of:

electrically connecting said first conductive film and a second conductive film provided on a periphery of said main funnel section for addition of capacitance, and indirectly connecting said transparent film to said second conductive film.

28. The method for providing protection from alternating electric fields in cathode ray tube of claim 27, wherein said electrically connecting step comprising the substep of:

grounding said second conductive film through an explosion-proof band wound around a perimeter of said face panel.

29. The method for providing protection from alternating electric fields in cathode ray tube of claim 26, further comprising the step of:

electrically insulating said first conductive film and said coils in said deflecting yoke.

30. A method for providing protection from alternating electric fields in cathode ray tube having a funnel including a neck section in which an electron gun is sealed, a main funnel section, and a cone section for connecting the neck section and the main funnel section, a face panel having a fluorescent film on an inner face thereof and being connected to another end of the main funnel section to which the cone section is connected, and a deflection yoke being fitted onto the cone section and containing coils for deflecting an electron beam emitted from the electron gun, comprising the steps of:

shielding a periphery of said cone section with a first conductive film in an area surrounded by a first circumference of a circle on an outer surface of an outer surface of said funnel having a larger diameter than the maximum diameter of a horizontal deflecting coil in said deflection yoke, and a second circumference of a circle on the outer surface of said funnel at least a predetermined distance away from a joint of said neck section towards said face panel;

forming a transparent conductive film on an outer surface of said face panel; and grounding said first conductive film and said transparent conductive film.

31. The method for providing protection from alternating electric fields in cathode ray tube of claim 30, further comprising the step of:

electrically connecting said first conductive film and a second conductive film provided on a periphery of said main funnel section for addition of capacitance.

32. The method for providing protection from alternating electric fields in cathode ray tube of claim 30, wherein said grounding step comprising the substep of:

electrically connecting said first conductive film and a second conductive film provided on a periphery of said main funnel section for addition of capacitance, and indirectly connecting said transparent film to said second conductive film.

33. The method for providing protection from alternating electric fields in cathode ray tube of claim 32, wherein said electrically connecting step comprising the substep of:

grounding said second conductive film through an explosion-proof band wound around a perimeter of said face panel.

34. The method for providing protection from alternating electric fields in cathode ray tube of claim 30, further comprising the step of:

electrically insulating said first conductive film and said horizontal deflecting coil in said deflecting yoke.

35. A cathode-ray tube device comprising:

(a) a funnel including:

(i) a neck section in which an electron gun is sealed;

(ii) a main funnel section; and (iii) a cone section for connecting said neck section and said main funnel section;

(b) a face panel having a fluorescent film on an inner face thereof and being connected to another end of said main funnel section opposite to one end of said main funnel section to which said cone section is connected;

(c) a deflection yoke being fitted onto said cone section of said funnel and containing coils for deflecting an electron beam emitted from said electron gun;

(d) a transparent conductive film formed on an outer surface of said face panel;

(e) a power supply connected to one end of said transparent conductive film for applying an optimum potential to said transparent conductive film for shielding an alternating electric field emitted from said deflection yoke; and (f) grounding means for functionally grounding an opposite end of said transparent conductive film.

36. The cathode-ray tube device as claimed in claim 35, wherein said grounding means is a resistor having a predetermined value.

37. The cathode-ray tube device as claimed in claim 35, wherein said power supply is a direct current power supply.

38. The cathode-ray tube device as claimed in claim 35, wherein said power supply is an alternating current power supply connected to one whose phase is opposite to that of the alternating electric field emitted from said deflection yoke.

39. A method for providing protection from alternating electric fields in cathode ray tube including a neck section in which an electron gun is sealed, a main funnel section, a cone section for connecting the neck section and the main funnel section, a face panel having a fluorescent film on an inner face thereof and being connected to another end of the main funnel section to which the cone section is connected, and a deflection yoke being fitted onto the cone section and containing coils for deflecting an electron beam emitted from the electron gun, comprising the steps of:

forming a transparent conductive film on an outer surface of said face panel;

supplying power to one end of said transparent conductive film for applying an optimum potential to said transparent conductive film for shielding an alternating electric field emitted from said deflection yoke; and functionally grounding an opposite end of said transparent conductive film.

40. The method of claim 39, wherein said functionally grounding step comprising the substep of:

connecting a resistor having a predetermined value between said opposite end of said transparent conductive film and a ground.

41. The method for providing protection from alternating electric fields in cathode ray tube of claim 39, wherein said step for supplying power comprising the substep of:

applying a direct current to said one end of the transparent conductive film.

42. The method for providing protection from alternating electric fields in cathode ray tube of claim 39, wherein said step for supplying power comprising the substep of:

applying an alternating current whose phase is opposite to that of the alternating electric field emitted from said deflection yoke.

* * * * *